US007793627B2

(12) United States Patent
Bang

(10) Patent No.: US 7,793,627 B2
(45) Date of Patent: Sep. 14, 2010

(54) VARIABLE VALVE LIFT APPARATUS

(75) Inventor: Sang Hyun Bang, Bucheon (KR)

(73) Assignee: Hyundai Motor Company, Seoul (KR)

( * ) Notice: Subject to any disclaimer, the term of this patent is extended or adjusted under 35 U.S.C. 154(b) by 290 days.

(21) Appl. No.: 11/966,174

(22) Filed: Dec. 28, 2007

(65) Prior Publication Data

US 2009/0126661 A1 May 21, 2009

(30) Foreign Application Priority Data

Nov. 19, 2007 (KR) ..... 10-2007-0118016

(51) Int. Cl.
*F01L 1/34* (2006.01)

(52) U.S. Cl. ..... 123/90.16; 123/90.12; 123/90.48

(58) Field of Classification Search ..... 123/90.15, 123/90.16, 90.48, 90.12
See application file for complete search history.

(56) References Cited

U.S. PATENT DOCUMENTS

| | | | | |
|---|---|---|---|---|
| 5,005,540 | A * | 4/1991 | Watanabe | 123/90.12 |
| 5,216,988 | A | 6/1993 | Taxon | |
| 2003/0005902 | A1 * | 1/2003 | Tsukui et al. | 123/188.9 |

* cited by examiner

*Primary Examiner*—Zelalem Eshete
(74) *Attorney, Agent, or Firm*—Morgan, Lewis & Bockius LLP

(57) ABSTRACT

A variable valve lift apparatus includes a lift body that contacts a cam and a valve. The lift body has a first hole for receiving hydraulic pressure and a second hole for exhausting the hydraulic pressure. A spring is provided in the lift body. A hydraulic pressure supplying portion supplies the hydraulic pressure to the first hole, and a hydraulic pressure exhausting portion receives the hydraulic pressure from the second hole.

11 Claims, 2 Drawing Sheets

VARIABLE VALVE LIFT APPARATUS

CROSS-REFERENCE TO RELATED APPLICATION

This application claims priority to, and the benefit of, Korean Patent Application No. 10-2007-0118016, filed in the Korean Intellectual Property Office on Nov. 19, 2007, the entire contents of which are incorporated herein by reference.

BACKGROUND OF THE INVENTION (a) Field of the Invention

The present invention relates to a variable valve lift apparatus.

(b) Description of the Related Art

In typical light load driving, the driver uses only around 30% of an engine's maximum power. In these conditions, the throttle valve is nearly closed, and the engine needs to work to draw in air. This causes cylinder pressure to be very low, leading to low fuel efficiency.

Cylinder deactivation is thus used at light load so that the throttle valve can be opened further to provide the same power output. This increases pressure in each cylinder. Cylinder deactivation is achieved by keeping the intake or exhaust valves closed for a particular cylinder.

A typical cylinder deactivation apparatus includes a three-part variable tappet, a lock pin, and a double cam. The three parts of the tappet can be separated from one another and cooperate with the double cam to deactivate a cylinder.

The double cam and variable tappet are costly to manufacture and complicated to assemble.

The above information disclosed in this Background section is only for enhancement of understanding of the background of the invention and therefore it may contain information that does not form the prior art that is already known in this country to a person of ordinary skill in the art.

SUMMARY OF THE INVENTION

A variable valve lift apparatus includes a lift body that contacts a cam and a valve. The lift body has a first hole for receiving hydraulic pressure and a second hole for exhausting the hydraulic pressure. A spring is provided in the lift body. A hydraulic pressure supplying portion supplies the hydraulic pressure to the first hole, and a hydraulic pressure exhausting portion receives the hydraulic pressure from the second hole.

The lift body may include a high lift body that is in contact with the cam, and a low lift body that is connected with the valve.

The hydraulic pressure supplying portion may include a hydraulic line for supplying the hydraulic pressure to the first hole, and a check valve for preventing the hydraulic pressure from flowing backward.

The hydraulic pressure supplying portion may have a groove for supplying the hydraulic pressure to the first hole.

The hydraulic pressure exhausting portion may include a hydraulic line for receiving the hydraulic pressure from the second hole, and a control portion for controlling the second hydraulic line. The control portion may include a plunger.

The hydraulic pressure exhausting portion may include a groove for exhausting the hydraulic pressure from the second hole.

DETAILED DESCRIPTION OF PREFERRED EMBODIMENTS

An exemplary embodiment the present invention will be described more fully hereinafter with reference to the accompanying drawings.

Figure 1:
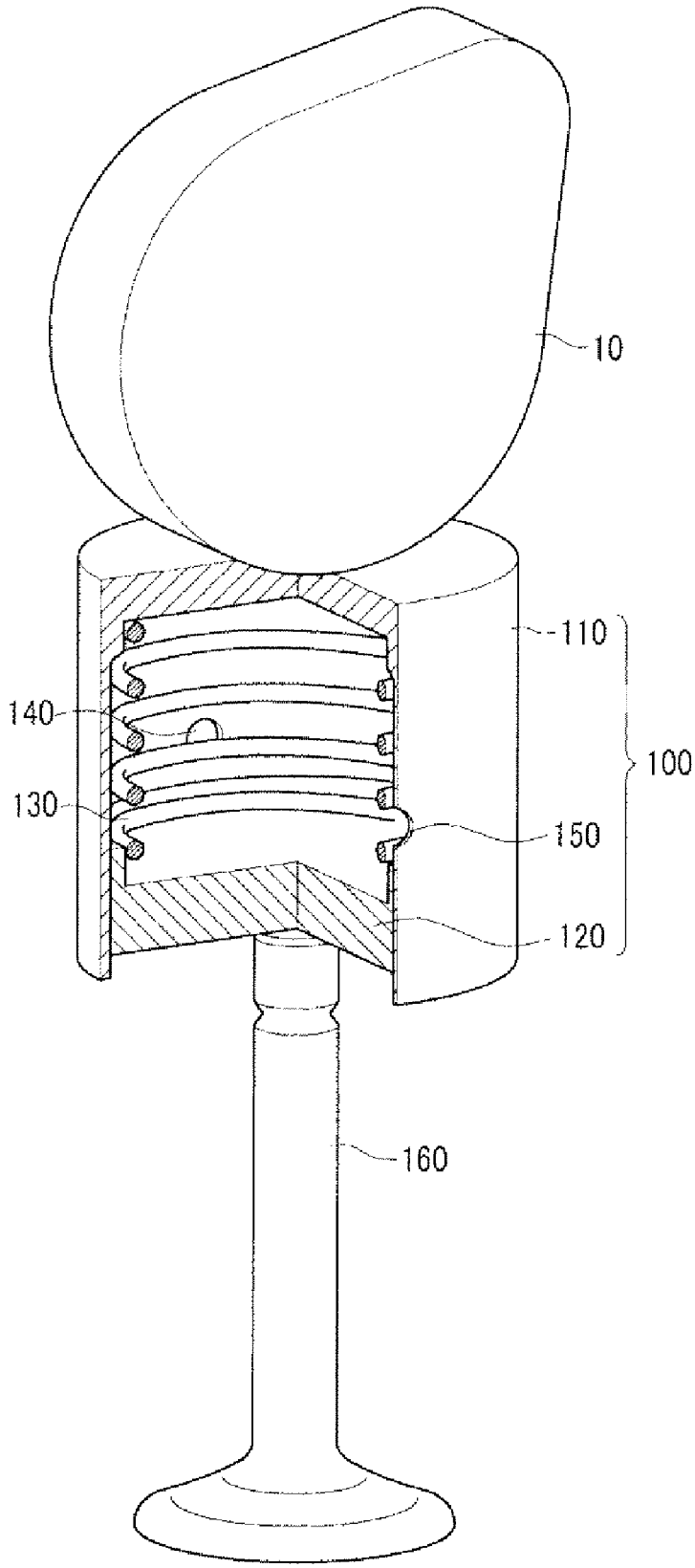
FIG. 1 is a perspective, partial cross-sectional view of a variable valve lift apparatus according to an exemplary embodiment of the present invention.

As shown in FIG. 1, a variable valve lift apparatus according to an exemplary embodiment of the present invention includes a lift body 100 that moves vertically by rotation of a cam 10, and opens and closes a valve 160. A lost motion spring 130 is disposed in the lift body 100. The lift body 100 includes a high lift body 110, that contacts the cam 10, and a low lift body 120, that is connected to the valve 160. A first hole 140 is provided in the lift body 100 for receiving hydraulic pressure. A second hole 150 is provided in the lift body 100 for exhausting hydraulic pressure.

Figure 2:
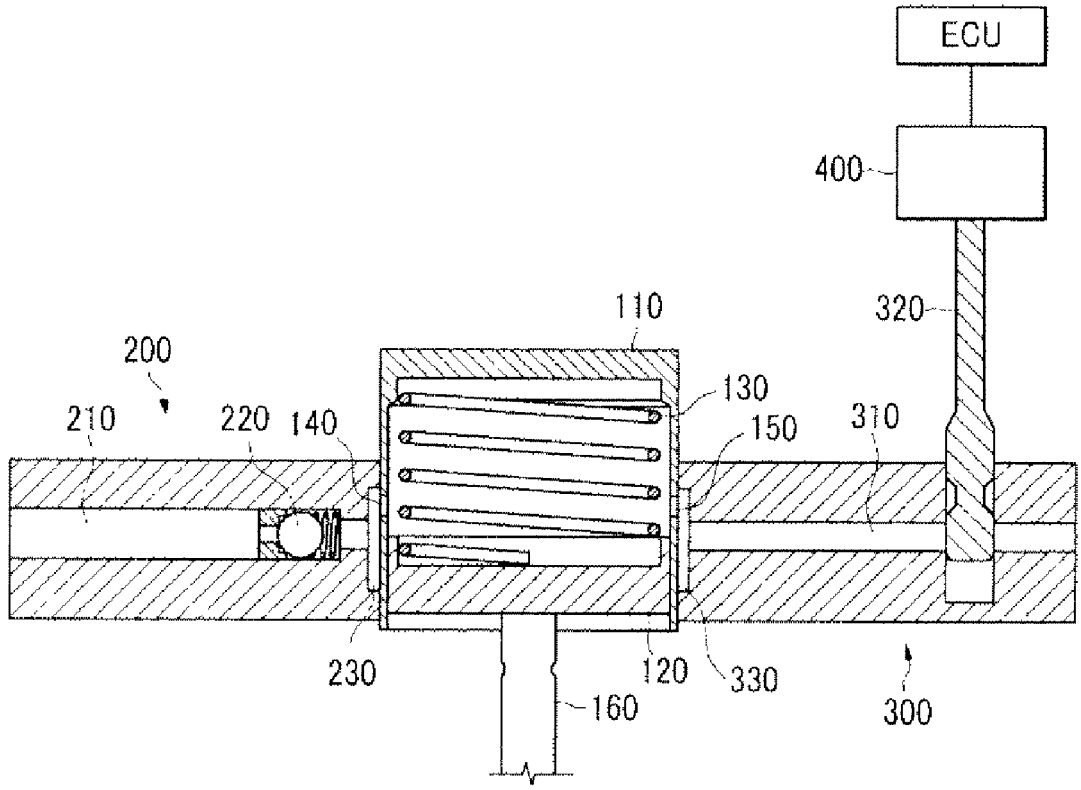
FIG. 2 is a schematic cross-sectional view of a "general" mode of a variable valve lift apparatus according to an exemplary embodiment of the present invention.
Figure 3:
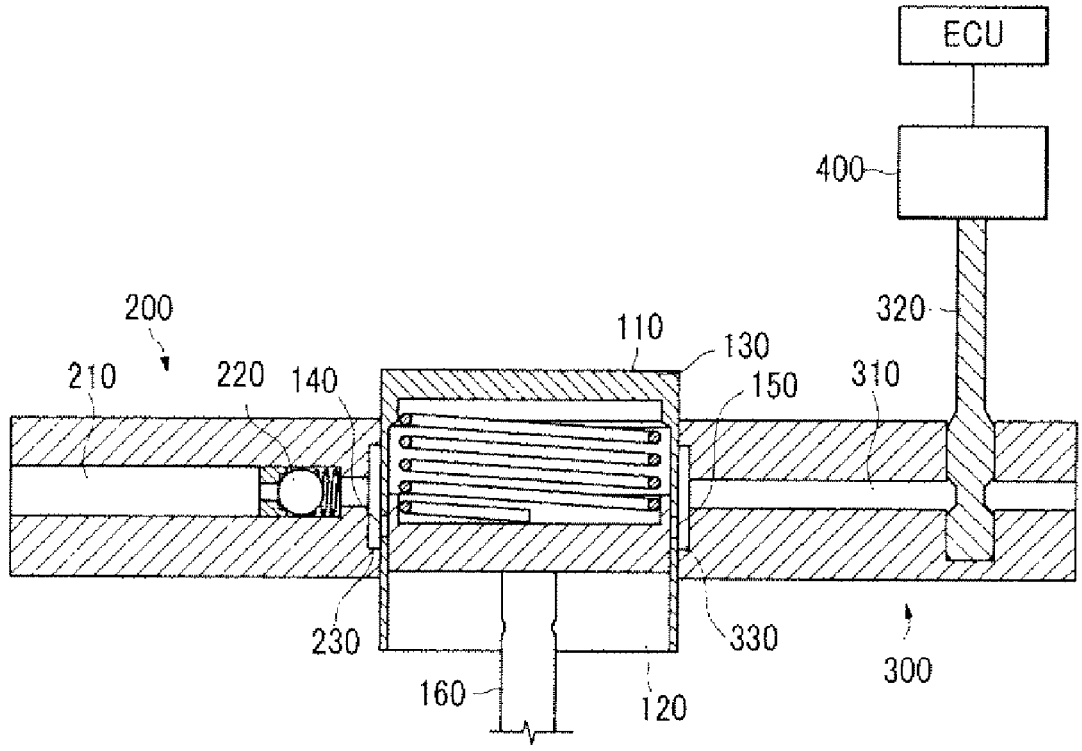
FIG. 3 is a schematic cross-sectional view of a CDA mode of a variable valve lift apparatus according to an exemplary embodiment of the present invention.

A hydraulic pressure supplying portion 200 for supplying hydraulic pressure to the first hole 140 and a hydraulic pressure exhausting portion 300 for receiving hydraulic pressure from the second hole 150 are shown in FIG. 2 and FIG. 3.

The hydraulic pressure supplying portion 200 includes a first hydraulic line 210 for supplying the hydraulic pressure to the first hole 140, and a cheek valve 220 for preventing the hydraulic pressure from flowing backward.

The cheek valve 220 allows hydraulic pressure to be supplied through the hydraulic pressure supplying portion 200 and prevents exhausting of hydraulic pressure.

A first groove 230 is provided in the hydraulic pressure supplying portion 200 for smoothly supplying the hydraulic pressure to the first hole 140.

The hydraulic pressure exhausting portion 300 includes a second hydraulic line 310 for receiving the hydraulic pressure from the second hole 150, and a control portion for controlling the second hydraulic line. The control portion includes a plunger 320, operated by a plunger operation portion 400, and the plunger operation portion 400 may be controlled by an electronic control unit (ECU). The plunger operation portion 400 may be a solenoid valve or another operating unit.

The ECU controls the plunger operation portion 400 according to an operation condition of a vehicle. The ECU 400 may include a processor, memory, and associated hardware, software, and/or firmware as may be selected and programmed by a person of ordinary skill in the art based on the teachings herein.

A second groove 330 is provided in the hydraulic pressure exhausting portion 300 for exhausting the hydraulic pressure from the second hole 150.

The first groove 230 and the second groove 330 cause the hydraulic pressure to be supplied and exhausted smoothly during motion of the lift body 100.

In a general mode, as shown in FIG. 2, hydraulic pressure supplied from a hydraulic pump (not shown) or so on is supplied to the lift body 100 through the first hydraulic line 210, and the second hydraulic line 310 is blocked by the plunger 320.

The pressure in the lift body 100 keeps the spring 130 expanded, as shown in FIG. 2, and the rotation of the cam 10 thus moves the entire lift body 100 up and down, to open and close the valve 160.

In CDA mode, as shown in FIG. 3, the plunger operation portion 400 opens the plunger 320, opening the second hydraulic line 310, and releasing the hydraulic pressure in the lift body 100.

Therefore, the rotation of the cam 10 compresses and releases the spring 130, and the low lift body 120 remains stationary. Thus, the valve 160 is not opened and closed.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A variable valve lift apparatus comprising:

a lift body that contacts a cam and slidably and continuously contacts a valve, wherein the lift body comprises a first hole for receiving hydraulic pressure and a second hole for exhausting the hydraulic pressure;

a spring disposed in the lift body and elastically supporting the lift body;

a hydraulic pressure supplying portion for supplying the hydraulic pressure to the first hole of the list body; and a hydraulic pressure exhausting portion for receiving the hydraulic pressure from the second hole of the list body, wherein the hydraulic pressure exhausting portion comprises a hydraulic line for receiving the hydraulic pressure from the second hole and a control portion controls the hydraulic pressure of the hydraulic line, and wherein the control portion comprises a plunger.

2. The variable valve lift apparatus of claim 1, wherein the lift body comprises a high lift body that is in contact with the cam, and a low lift body that is connected with the valve.

3. The variable valve lift apparatus of claim 1, wherein the hydraulic pressure supplying portion comprises a hydraulic line for supplying the hydraulic pressure to the first hole, and a check valve for preventing the hydraulic pressure from flowing backward.

4. The variable valve lift apparatus of claim 1, wherein the hydraulic pressure supplying portion comprises a groove for supplying the hydraulic pressure to the first hole.

5. The variable valve lift apparatus of claim 1, wherein the hydraulic pressure exhausting portion comprises a groove for exhausting the hydraulic pressure from the second hole.

6. A variable valve lift apparatus comprising:

a lift body that contacts a cam and slidably and continuously contacts a valve, wherein the lift body comprises a first hole for receiving hydraulic pressure and a second hole for exhausting the hydraulic pressure;

a spring disposed in the lift body and elastically supporting the lift body;

a hydraulic pressure supplying portion for supplying the hydraulic pressure to the first hole of the list body; and a hydraulic pressure exhausting portion for receiving the hydraulic pressure from the second hole of the list body;

wherein the hydraulic pressure exhausting portion comprises a hydraulic line for receiving the hydraulic pressure from the second hole and a control portion controls the hydraulic pressure of the hydraulic line.

7. The variable valve lift apparatus of claim 6, wherein the lift body comprises a high lift body that is in contact with the cam, and a low lift body that is connected with the valve.

8. The variable valve lift apparatus of claim 6, wherein the hydraulic pressure supplying portion comprises a hydraulic line for supplying the hydraulic pressure to the first hole, and a check valve for preventing the hydraulic pressure from flowing backward.

9. The variable valve lift apparatus of claim 6, wherein the hydraulic pressure supplying portion comprises a groove for supplying the hydraulic pressure to the first hole.

10. The variable valve lift apparatus of claim 6, wherein the control portion comprises a plunger.

11. The variable valve lift apparatus of claim 6, wherein the hydraulic pressure exhausting portion comprises a groove for exhausting the hydraulic pressure from the second hole.

* * * * *

UNITED STATES PATENT AND TRADEMARK OFFICE

CERTIFICATE OF CORRECTION

PATENT NO. : 7,793,627 B2
APPLICATION NO. : 11/966174
DATED : September 14, 2010
INVENTOR(S) : Sang Hyun Bang It is certified that error appears in the above-identified patent and that said Letters Patent is hereby corrected as shown below:

IN THE CLAIMS

At Col. 3, in claim 1, lines 33 and 36, change "list body" to --lift body--.

At Col. 4, in claim 6, lines 20 and 22, change "list body" to --lift body--.

Signed and Sealed this

Sixteenth Day of November, 2010

David J. Kappos

David J. Kappos
*Director of the United States Patent and Trademark Office*